US012618195B2

(12) United States Patent
Villa-Nuottajärvi et al.

(10) Patent No.: US 12,618,195 B2
(45) Date of Patent: May 5, 2026

(54) PRESS FELT

(71) Applicant: Valmet Technologies, Inc., Espoo (FI)

(72) Inventors: Viivi Villa-Nuottajärvi, Espoo (FI); Kati Mikkonen, Espoo (FI); Jorma Naamanka, Espoo (FI); Susanna Moisio, Espoo (FI); Juha Hynninen, Espoo (FI); Leena Silakoski, Espoo (FI)

(73) Assignee: Valmet Technologies, Inc., Espoo (FI)

( * ) Notice: Subject to any disclaimer, the term of this patent is extended or adjusted under 35 U.S.C. 154(b) by 116 days.

(21) Appl. No.: 18/515,387

(22) Filed: Nov. 21, 2023

(65) Prior Publication Data

US 2024/0175208 A1 May 30, 2024

(30) Foreign Application Priority Data

Nov. 24, 2022 (FI) ..... 20226049

(51) Int. Cl.
*D21F 7/10* (2006.01)
*D21F 7/08* (2006.01)

(52) U.S. Cl.
CPC ..... *D21F 7/10* (2013.01); *D21F 7/083* (2013.01)

(58) Field of Classification Search
CPC ..... D21F 7/10; D21F 7/083; D21F 1/0072; D21F 3/02; D21F 3/00; D04H 1/4391; D04H 1/498; D10B 2331/02
See application file for complete search history.

(56) References Cited

U.S. PATENT DOCUMENTS 4,583,302 A 4/1986 Smith
5,240,763 A * 8/1993 Wagner ..... D21F 1/0027 162/902
6,302,155 B1 * 10/2001 Rydin ..... D21F 1/0054 139/383 A
2009/0123706 A1 * 5/2009 Takahashi ..... D21F 7/083 442/326
2011/0290443 A1 * 12/2011 Kockritz ..... D21F 7/083 162/358.2

FOREIGN PATENT DOCUMENTS

WO 2016091820 A2 6/2016

* cited by examiner

*Primary Examiner* — Abbas Rashid
*Assistant Examiner* — Elisa H Vera
(74) *Attorney, Agent, or Firm* — Stiennon & Stiennon

(57) ABSTRACT

A press felt (100) has a seam and a web-side and a machine-side. The press felt (100) has a first fiber layer (131) on the web-side, a second fiber layer (132) on the machine-side, and at least one woven base fabric (110) and at least one spiral fabric (120) between the fiber layers (131, 132).

18 Claims, 1 Drawing Sheet

PRESS FELT

CROSS REFERENCES TO RELATED APPLICATIONS

This application claims priority on FI 20226049, filed Nov. 24, 2022, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to press felts used in fiber web machines.

A press felt plays an important role in removing the water from a fiber web in a press section of fiber web machines. The press felt conveys the web through the press section and receives water removed from the web during pressing. At the same time, the press felt imparts smoothness of the web and conveys it to a dryer section. A modern press felt comprises at least one base fabric and a fiber layer at least on one surface of the base fabric. The base fabric can be a woven or non-woven fabric consisting of 1-4 layers.

Conventionally used press felts have a low surface area, which enables producing of a web having a smooth surface. In other words, the conventionally used press felts have no marking effect. The marking effect means that the press felt produces uneven and structured surface on the web. There is thus a need for novel press felts having the marking effect. Further, the conventionally used press felts may have insufficient water removal properties due to the low surface area. Thus, there is also need for a novel press felt with an increased surface area for better evaporation of moisture from a pulp.

SUMMARY OF THE INVENTION

An object of at least some of the present embodiments is to provide a press felt having a marking effect and an increased surface area for better evaporation of moisture from a pulp.

According to a first aspect of the present invention, there is provided a press felt having a seam and a web-side and a machine-side, the press felt having

- a first fiber layer on the web-side,
- a second fiber layer on the machine-side, and
- at least one woven base fabric and at least one spiral fabric between the fiber layers.

According to a second aspect of the present invention, there is provided use of the present press felt in a fiber web machine, such as a paper machine, a cardboard machine, a tissue machine or a pulp machine.

DESCRIPTION OF THE PREFERRED EMBODIMENTS

Figure 1:
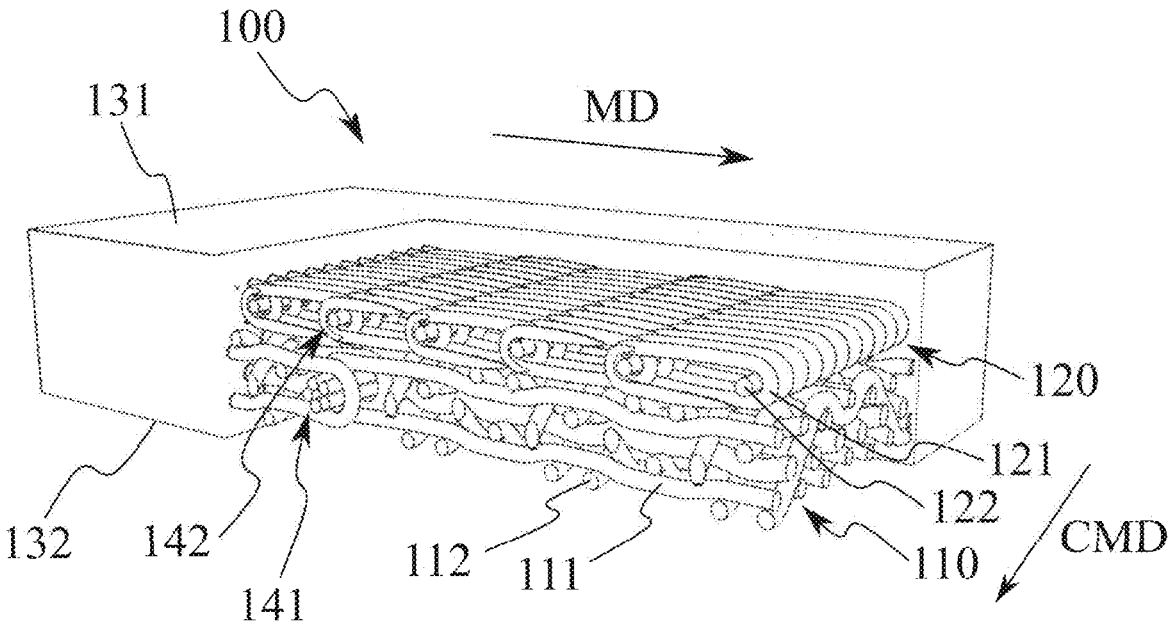
FIG. 1 is a fragmentary perspective view of a press felt in accordance with at least some embodiments of the present invention.

In the present context, the term "spiral fabric" refers to a fabric comprising a plurality of spiral loop yarns and a plurality of pintle wires connecting the spiral yarns together. The spiral loop yarns interweave with adjacent spiral loop yarns like a zipper. The adjacent spiral loop yarns form a channel between the adjacent spiral loop yarns. The adjacent spiral loop yarns are connected with a pintle wire extending through the channel. There are free spaces inside loops of the spiral loop yarns, which free spaces can be filled with filler yarns.

In the present context, the term "loop size" refers to a length (L) of a loop of the spiral loop yarn. The length is substantially perpendicularly or angled to a length direction of a pintle wire in a plane of a spiral fabric.

In the present context, the term "web-side" refers to a side of a press felt, which side faces a fiber web, such as paper, board, pulp or tissue, produced, when the press felt is used in a fiber web machine, for example a paper, board, pulp or tissue machine.

In the present context, the term "machine-side" refers to a side of the press felt, which side is in contact with equipment of the fiber web machine, when the press felt is used in the fiber web machine.

In the present context, the term "machine direction" refers to a direction, which is parallel to the moving direction of the press felt in the fiber web machine, when the press felt is used in the fiber web machine.

In the present context, the term "cross machine direction" refers to a direction, which is perpendicular to the moving direction of the press felt in the fiber web machine, when the press felt is used in the fiber web machine.

A press felt plays an important role in forming of a surface and removing the water from a fiber web in a press section of a fiber web machine, such as a paper or a cardboard machine, or especially a pulp machine. At least some of the present embodiments provide a press felt having a marking effect, which can give an increased surface area for the fiber web for better evaporation of moisture from the fiber web in a drying section.

According to an embodiment, a press felt 100 having a seam and a web-side and a machine-side comprises:

- a first fiber layer 131 on the web-side,
- a second fiber layer 132 on the machine-side, and
- at least one woven base fabric 110 and at least one spiral fabric 120 between the fiber layers 131, 132.

The spiral fabric has a more robust and rough structure, so that compared with the woven base fabric, the spiral fabric brings better mechanical marking effect. This marking effect increases a surface area of the fiber web, so that later on, drying of the fiber web is more energy efficient.

The press felt 100 can comprise 1-4, preferably 1-2, woven base fabrics 110. Higher void volume, stability and strength can be achieved with two or more woven base fabrics. The woven base fabric can have at least one yarn layer, preferably 1-4 yarn layers.

The press felt 100 can comprise 1-2, preferably one, spiral fabric(s) 120. Higher void volume can be achieved with two or more spiral fabrics.

According to an embodiment, the at least one spiral fabric 120 is on the web-side or the machine-side of the at least one woven base fabric 110. When the at least one spiral fabric is on the web-side, a web-side surface of the press felt is coarse and granular, because a surface structure of the spiral fabric affects through the fiber layer. Thus, the at least one spiral fabric has a stronger marking effect on the web. Alternatively, when the at least one spiral fabric is on the machine-side, a web-side surface of the press felt is at least relatively smooth and even, because the surface structure of the spiral fabric does not affect or does not affect significantly through the fiber layer. Thus, the at least one spiral fabric has no marking effect or has a weaker marking effect on the fiber web.

When the press felt 100 comprises more than one woven base fabric 110, the woven base fabrics 110 can be arranged on top of each other forming a stack of woven base fabrics. Respectively, when the press felt 100 comprises more than one spiral fabric 120, the spiral fabrics can be arranged top of each other forming a stack of spiral fabrics. The stack of the spiral fabrics, or preferably one spiral fabric 120, can be arranged on the machine-side or the web-side of the stack of the woven base fabrics 110. Alternatively, the woven base fabrics 110 can alternate with the spiral fabrics 120.

The fiber layers 131, 132 can comprise individual fibers, which are needled to at least one woven base fabric 110 and at least one spiral fabric 120 to form the fiber layers 131, 132 on the web-side and the machine-side of the press felt 100.

According to an embodiment, the first and second fiber layers 131, 132 are configured to extend through the at least one woven base fabric 110 and the at least one spiral fabric 120, attaching the at least one woven base fabric 110 and the at least one spiral fabric 120 together. Thus, there is no need for an additional stage for attaching the fabrics together, but fibers of the fiber layers can be needled through the fabrics. Indeed, the fiber layers extending through the base fabric and the spiral fabric is obtainable by needling the fibers of either the first fiber layer, the second fiber layer, or both, through the woven base fabric(s) and the spiral fabric(s) arranged in between the fiber layers, in such a manner that the fibers of at least one of the fiber layers extends until the other fiber layer, thus attaching all the layers and fabrics of the press felt together.

According to an embodiment, the at least one woven base fabric 110 comprises machine direction (MD) yarns 111 and cross machine direction (CMD) yarns 112, and the at least one spiral fabric 120 comprises spiral loop yarns 121 and pintle wires 122. The machine direction yarns 111 and the cross machine direction yarns 112 are crossing each other and thus engaging each other together. The spiral loop yarns form a channel in a first direction, when arranged adjacent to one another, i.e., between the adjacent spiral loop yarns. The adjacent spiral loop yarns are connected with a pintle wire extending through the channel. Typically, in a second direction, which is perpendicular to the first direction in the plane of the spiral fabric, two loops are overlapping, such that a pintle wire is arranged to extend through to adjacent channels, as shown in FIG. 1.

According to an embodiment, the pintle wires 122 are arranged in a cross machine direction (CMD), as shown in FIG. 1, or angled to the cross machine direction in a plane of the spiral fabric 120. The pintle wires 122 can be slightly angled, such as 0.1-10 degrees, to the cross machine direction in the plane of the spiral fabric 120. In other words, a direction of the pintle wires 122 can be, at least substantially, the same than the direction of the cross machine direction yarns 112 of the at least one woven base fabric 110. Thus, the channels between adjacent spiral loop yarns are formed, at least substantially, in the cross machine direction of the press felt. Due to this, the seaming of the press felt is easier, because a seam can be formed in the cross machine direction in all base fabrics, namely in the woven base fabric(s) and the spiral fabric(s). In addition, then the seam of the spiral fabric(s) is identical to a spiral fabric body itself and thus it cannot be distinguished from the body.

According to the embodiment, the seam is a double seam structure comprising a first seam 141 in the at least one woven base fabric 110 and a second seam 142 in the at least one spiral fabric 120. The at least one woven base fabric 110 and the at least one spiral fabric 120 can have a cross machine direction (CMD) width and a machine direction (MD) length with two opposing machine direction (MD) ends, namely a first end and a second end, which are joined together to form a continuous press felt. Thus, the press felt forms a loop when the press felt is used in the fiber web machine. The double seam provides a safe and easy installation of the press felt.

According to an embodiment, the first seam is formed of woven fabric loops and the second seam is formed of spiral loops. The woven fabric loops can be formed at the ends of the woven base fabric 110 to be joined. The woven fabric loops can be formed of machine direction yarns 111 of the woven base fabric 110. The spiral loops can be formed at the ends of the spiral fabric 120 to be joined. The spiral loops can be formed of loops of the spiral loop yarns 121 of the spiral fabric 120.

The woven fabric loops of the first end of the woven base fabric 110 can alternately intermesh with the woven fabrics loops of the second end of the woven base fabric 110, when the ends are aligned against each other to form an endless press felt. Respectively, the spiral loops of the first end of the spiral fabric 120 can alternately intermesh with the spiral loops of the second end of the spiral fabric 110, when the ends are aligned against each other to form the endless press felt. This alternating intermeshing arrangement of the loops forms a substantially tubular passageway through which a pintle may be inserted. When the pintle is inserted through the passageway, it attaches the ends together thus providing an endless press felt.

When the press felt 100 comprises more than one woven base fabric 110 and/or spiral fabric 120, the two opposing machine direction ends of all the individual woven base fabrics 100 and/or the spiral fabrics 120, which fabrics together form the press felt 100, can be joined together separately or simultaneously.

The two opposing machine direction ends can be joined together when the press felt is installed on a press section of a fiber web machine. Joining of the seam loops together with a pintle can be started from the fabric edge. The seaming process can be continued until the pintle is passed all the way through the woven fabric loops and the spiral loops.

According to an embodiment, the spiral loop yarns 121 comprise a polymer, preferably a polyamide (PA). Press felts made out of polyamide yarn have excellent strength and wear resistance.

According to an embodiment, the polyamide is selected from polyamide 4.6, polyamide 4.10, polyamide 5.6, polyamide 5.10, polyamide 6, polyamide 6.6, polyamide 6.10, polyamide 6.12, polyamide 10, polyamide 11, and polyamide 12, or mixtures thereof. By mixtures (also for other instances below) it is meant that the product can comprise in a same yarn or fiber more than one type of polyamide, or that the product can comprise in different yarns or fibers different types of polyamides. The above-mentioned polyamides are excellent choices when mechanical strength and wear resistance is needed. Polyamide 6 fibers are tough, possessing high tensile strength and elasticity. They are highly resistant to abrasion and chemicals such as acids and alkalis. Polyamide 6 has high water absorption. Polyamide 6.6 has high mechanical strength, rigidity and good heat and chemical stability. Polyamide 6.10 has high impact resistance, chemical resistance and retention of dimension. Polyamide 11 has lower values of density, flexural and Young's modulus, water absorption, as well as melting and glass transition temperatures than polyamide 6. However, polyamide 11 has increased dimensional stability in the presence of moisture than polyamide 6.

According to an embodiment, cross-sections of the spiral loop yarns 121 are round, oval, diamond, quadrangle or quadrangle with rounded edges. These cross-sections provide a coarse and granular surface and a high surface area for the spiral fabric. Therefore, the press felt has the marking effect, when the at least one spiral fabric is on the web-side. In addition, water removal properties of the press felts are improved.

According to an embodiment, diameters of the spiral loop yarns 121 are 0.1-3 mm, preferably 0.1-0.6 mm. The spiral loop yarns with smaller diameters, such as about 0.1-1 mm, provide a smaller surface area and thus smoother surface for the press felt. On the other hand, the spiral loop yarns with larger diameters, such as about 2-3 mm, have a higher surface area and thus a coarser and more granular surface for the press felt. In addition, the larger diameters provide good tensile strength and air permeability.

According to an embodiment, loop sizes L of the spiral loop yarns 121 are 0.2-15 mm, preferably 0.2-10, more preferably 2-6 mm. A larger loop size enables the possibility of using pintle wires having a larger diameter, which affects the marking effect. With a smaller loop size, pintle wires having a smaller diameter can be employed. This allows for a more flexible yarn and loop size selection depending on the operation conditions. A larger loop size, such as about 10-15 mm, provides a smaller surface area for the press felt than a smaller loop size, such as about 0.2-1 mm. On the other hand, the smaller loop size provides a coarser and more granular surface than the larger loop size, because the distance between the pintle wires 122 becomes shorter.

The spiral fabric 120 can be a winded fabric. In the winded fabric, filaments of spiral loop yarns 121 are wound into spiral loops and the spiral loops are connected together by pintle wires 122.

The pintle wires 122 can comprise a polymer, preferably a polyamide (PA). The polyamide can be selected from polyamide 4.6, polyamide 4.10, polyamide 5.6, polyamide 5.10, polyamide 6, polyamide 6.6, polyamide 6.10, polyamide 6.12, polyamide 10, polyamide 11, and polyamide 12, and mixtures thereof. The pintle wires made out by polyamide have excellent strength and wear resistance.

Diameters of the pintle wires 122 can be 0.1-14 mm, preferably 0.3-0.9 mm. Preferably, the pintle wires all have essentially the same diameter.

According to an embodiment, the spiral fabric 120 further comprises filler yarns 123 inside the loops of the spiral loop yarns 121. The filler yarn can be used to reduce air permeability, if needed, and to enhance fiber entanglement of fibers of the fiber layers 131, 132.

According to an embodiment, the filler yarns 123 are monofilament, multifilament or twisted yarns. Preferably, the filler yarns are twisted yarns, which enhance fiber entanglement with fibers of the fiber layers 131, 132. Thus, it is easier to attach the fibers of the fiber layers 131, 132 to the spiral fabric 120. In addition, this enhances attaching the fabric layers together.

The fibers of the fiber layers 131, 132 can be attached to the at least one woven base fabric 110 and at least one spiral fabric 120 by needling.

The amount of the fibers of the fiber layers 131, 132 can be for example, 50-2000 g/m2.

The diameters of the machine direction yarns 111 and the cross machine direction yarns 112 of the at least one woven base fabric 110 can be 150-500 μm. Preferably, all the yarns of the base fabric have essentially the same diameter.

The machine direction yarns 111 and the cross machine direction yarns 112 of the at least one woven base fabric 110 can comprise a polyamide (PA). The polyamide can be selected from polyamide 4.6, polyamide 4.10, polyamide 5.6, polyamide 5.10, polyamide 6, polyamide 6.6, polyamide 6.10, polyamide 6.12, polyamide 10, polyamide 11 and polyamide 12, and mixtures thereof. Alternatively, the polyamide fibers can comprise copolyamides derived from more than one of the above-mentioned polyamides, or the polyamide fibers can be bicomponent fibers comprising two of the above-mentioned polyamides. Preferably, the polyamide fibers comprise polyamide 11. Polyamide 11 has good dimensional stability in the presence of moisture.

The above-described press felt 100 can be used in a paper machine, a cardboard machine, a tissue machine or a pulp machine.

DETAILED DESCRIPTION OF DRAWINGS

FIG. 1 illustrates a press felt 100 in accordance with at least some embodiments of the present invention. The press felt 100 comprises a first fiber layer 131 on the web-side and a second fiber layer 132 on the machine-side. Further, the press felt 100 comprises a woven base fabric 110 and a spiral fabric 120 between the fiber layers 131, 132. The woven base fabric 110 comprises three layers. The spiral fabric 120 is on the web-side of the woven base fabric 110. The woven base fabric 110 comprises machine direction (MD) yarns 111 and cross machine direction (CMD) yarns 112, and the spiral fabric 120 comprises spiral loop yarns 121 and pintle wires 122. The pintle wires 122 are arranged in the cross machine direction in a plane of the spiral fabric 120. A seam of the press felt is a double seam structure comprising a first seam 141 in the woven base fabric 110 and a second seam 142 in the spiral fabric 120. The first seam 141 is formed of woven fabric loops. The second seam 142 is formed of spiral loops. So, the second seam 142 is identical to the spiral fabric body itself and thus invisible.

Figure 2:
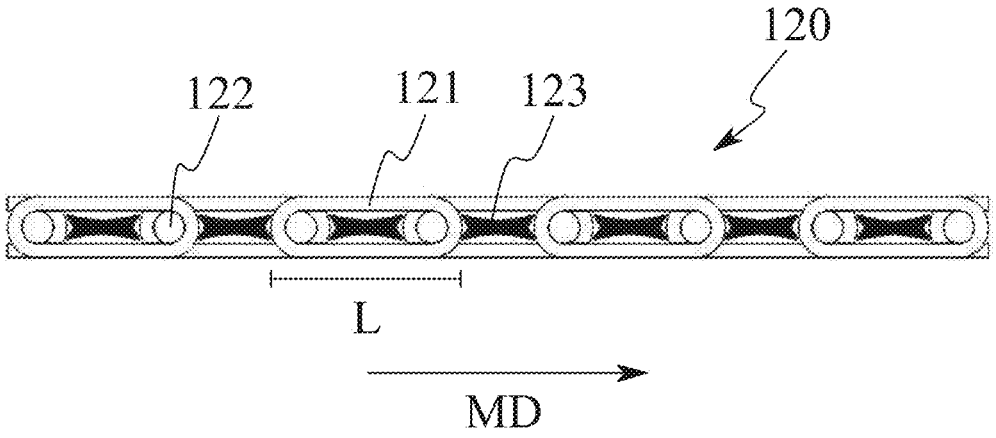
FIG. 2 is a fragmentary side view of a spiral fabric in accordance with at least some embodiments of the present invention.

FIG. 2 illustrates a spiral fabric 120 in accordance with at least some embodiments of the present invention. The spiral fabric 120 comprises spiral loop yarns 121 and pintle wires 122. The spiral fabric 120 further comprises filler yarns 123 inside loops of the spiral loop yarns 121. The spiral loop yarns 121 have a loop size L being a length of a loop of the spiral loop yarn in the machine direction (MD) of the press felt.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention.

The verb "to comprise" is used in this document as an open limitation that neither excludes nor requires the existence of also un-recited features. The features recited in depending claims are mutually freely combinable unless otherwise explicitly stated. Furthermore, it is to be understood that the use of "a" or "an", i.e., a singular form, throughout this document does not exclude a plurality.

We claim:

1. A press felt having a seam and a web-side and a machine-side, the press felt comprising:

a first fiber layer on the web-side;

a second fiber layer on the machine-side;

at least one woven base fabric and at least one spiral fabric between the fiber layers, wherein the at least one spiral fabric comprises:

a plurality of spiral loop yarns, wherein adjacent spiral loop yarns form channels therebetween, the adjacent spiral loop yarns and channels positioned to extend around the press felt when it is installed in a paper machine, a cardboard machine, a tissue machine or a pulp machine;

a plurality of pintle wires each extending through one of said channels, and thereby connecting adjacent spiral loop yarns;

wherein the spiral loop yarns have loops exterior to the channels with free spaces inside the loops; and wherein filler yarns extend inside the free spaces to enhance entanglement with an adjacent one of the fiber layers, wherein the filler yarns are twisted yarns.

2. The press felt of claim 1, wherein the at least one spiral fabric is on the web-side of the at least one woven base fabric.

3. The press felt of claim 1, wherein the at least one spiral fabric is on the machine-side of the at least one woven base fabric.

4. The press felt of claim 1, wherein the first and second fiber layers are configured to extend through the at least one woven base fabric and the at least one spiral fabric, attaching the at least one woven base fabric and the at least one spiral fabric together.

5. The press felt of claim 1, wherein the at least one woven base fabric comprises machine direction yarns and cross machine direction yarns; and the at least one spiral fabric comprises spiral loop yarns and pintle wires.

6. The press felt of claim 5, wherein the pintle wires are arranged in a cross machine direction or angled to the cross machine direction in a plane of the spiral fabric.

7. The press felt of claim 1, wherein the seam is a double seam structure comprising a first seam in the at least one woven base fabric and a second seam in the at least one spiral fabric.

8. The press felt of claim 7, wherein the first seam is formed of woven fabric loops and the second seam is formed of spiral loops.

9. The press felt of claim 1, wherein the spiral loop yarns comprise a polymer.

10. The press felt of claim 9 wherein the polymer comprising the spiral loop yarns is polyamide.

11. The press felt of claim 10, wherein the polyamide is selected from polyamide 4.6, polyamide 4.10, polyamide 5.6, polyamide 5.10, polyamide 6, polyamide 6.6, polyamide 6.10, polyamide 6.12, polyamide 10, polyamide 11, and polyamide 12, or mixtures thereof.

12. The press felt of claim 1, wherein cross-sections of the spiral loop yarns are round, oval, diamond, quadrangle or quadrangle with rounded edges.

13. The press felt of claim 1, wherein diameters of the spiral loop yarns are 0.1-3 mm.

14. The press felt of claim 1, wherein the diameters of the spiral loop yarns are 0.1-0.6 mm.

15. The press felt of claim 1, wherein loop sizes of the spiral loop yarns are 0.2-15 mm.

16. The press felt of claim 1 wherein the loop sizes of the spiral loop yarns are 0.2-10 mm.

17. The press felt of claim 16 wherein the loop sizes of the spiral loop yarns are 2-6 mm.

18. A method comprising the steps of:

positioning the press felt of claim 1 as a looped element within a paper machine, a cardboard machine, a tissue machine or a pulp machine; and advancing the looped element in a machine direction to receive fibers thereon for the formation of paper, cardboard, tissue or pulp.

* * * * *